US005631729A

United States Patent [19]

Nagayasu

[11] Patent Number: 5,631,729

[45] Date of Patent: May 20, 1997

[54] IMAGE FORMING APPARATUS

[75] Inventor: Keiko Nagayasu, Ibaraki, Japan

[73] Assignee: Minolta Co., Ltd., Osaka, Japan

[21] Appl. No.: 557,297

[22] Filed: Nov. 13, 1995

[30] Foreign Application Priority Data

Nov. 11, 1994 [JP] Japan ..... 6-277273

[51] Int. Cl.[6] ..... G03G 21/00

[52] U.S. Cl. ..... 355/296; 355/269; 430/109

[58] Field of Search ..... 355/245, 296, 355/299, 301, 268, 251, 270, 269, 285; 430/45, 105, 49, 110, 111, 109, 108, 137, 125; 118/652

[56] References Cited

U.S. PATENT DOCUMENTS 4,642,448 2/1987 Shigemura et al. ..... 355/285 X
5,283,618 2/1994 Hosoya et al. ..... 355/269
5,328,792 7/1994 Shigemori et al. ..... 430/106.6

*Primary Examiner*—Shuk Yin Lee
*Attorney, Agent, or Firm*—Sidley & Austin

[57] ABSTRACT

An image forming apparatus for forming a latent image on a photosensitive member, developing the latent image by a developing device, transferring the developed image onto a sheet, and cleaning a residual toner remaining on the photosensitive member after transferring by the developing device. The image forming device has a shaver which shaves the surface of the photosensitive member within a range of about 2 μm or greater but less than 15 μm, within 7,000 rotations of the photosensitive member. Further the toner for developing the latent image satisfies the following conditions:

55° C.≦Tg

80° C.≦Ti≦120° C.

100° C.≦Tm≦135° C., wherein Tg is a glass transition temperature, Ti is a softening point at a moment a plunger of a flow tester starts to drop, and Tm is a softening point at a moment the plunger of the flow tester has dropped 6 mm.

4 Claims, 2 Drawing Sheets

FIG. 2
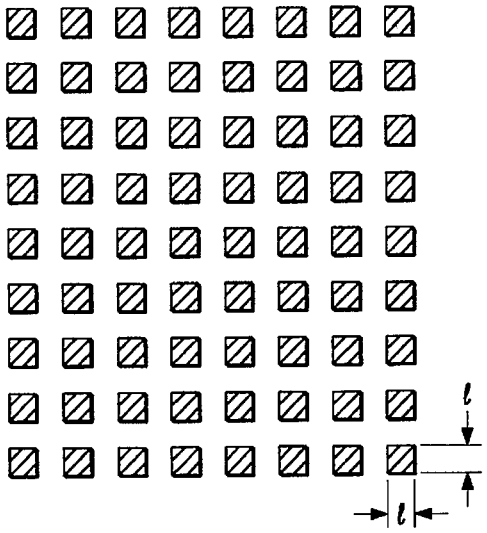
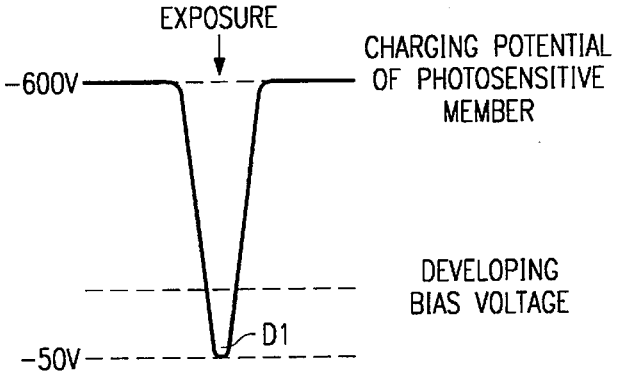
FIG. 3A
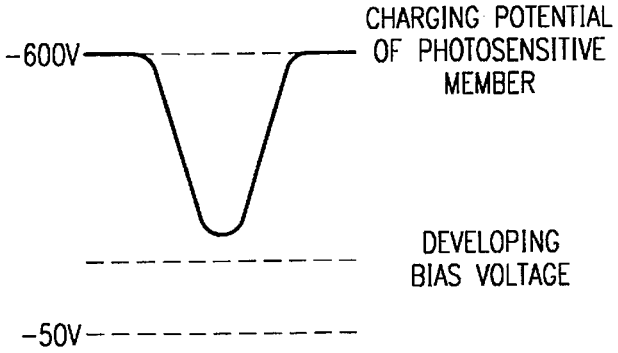
FIG. 3B

IMAGE FORMING APPARATUS

BACKGROUND OF THE INVENTION

1. Field of the Invention

The present invention relates to an image forming apparatus such as electrophotographic copiers, printers and the like.

2. Description of the Related Art

In image forming apparatus such as electrophotographic copiers and printers and the like, generally, a photosensitive member is charged by a charging device, and the charged region is subjected to optical image exposure so as to form an electrostatic latent image thereon. This latent image is developed into a visible toner image which is transferred onto a transfer member and fixed thereon. After the aforesaid transfer, the residual toner remaining on the surface of the photosensitive member is removed therefrom by a cleaning device.

In recent years, various apparatus have been proposed which omit a cleaning device in accordance with demand for lower cost and more compact apparatus.

For example, U.S. Pat. No. 5,148,219, U.S. Pat. No. 5,283,618, and U.S. Pat. No. 5,328,792 disclose so-called cleanerless image forming apparatus which combine a cleaning device with a developing device.

In cleanerless image forming apparatus, however, inadequate charging and subsequent inadequate optical exposure (so-called exposure memory) readily occurs when a charging process and optical exposure process are accomplished over residual toner remaining on the surface of the photosensitive member following a previous toner image transfer. As a result, a so-called residual toner memory and inadequate exposure memory are developed in a subsequent image, thereby producing a defective image.

In order to eliminate the aforesaid problems, U.S. Pat. No. 5,148,219 discloses an agitating/charging device capable of disturbing the untransferred residual toner into a non-pattern which is used as a charging device; and U.S. Pat. No. 5,283,618 discloses settings of developing toner resistance value, developing toner charge amount, and residual toner charge amount within predetermined ranges.

In image forming apparatus having cleanerless construction, it is difficult to both maintain suitable density of the formed image and collect the post-transfer residual toner by a developing device. Thus, U.S. Pat. No. 5,328,792 discloses an improvement of both image density and cleaning characteristics by using as a developer a novel nonmagnetic monocomponent developer.

So-called cleanerless image forming apparatus still have the disadvantages described below, however.

In image forming apparatus having a cleaning device, residual toner remaining on the surface of a photosensitive member is removed by a cleaning member such as a blade or a brush and the surface of the photosensitive member is shaved at the same time. When a cleaning device is not used, however, a toner film readily forms on the surface of the photosensitive member because there is no member present to suitably shave the photosensitive member. This toner filming is a phenomenon that a thin film of toner adheres over the entire surface of the photosensitive member.

If conventional toner is used, this toner filming does not become a visible problem insofar as so much repeated image formations are not performed. However, when low melting point toner i.e., toner having Ti (the softening point at the moment the plunger of the flow tester starts to drop) less than 120° C. and Tm (the softening point at the moment the plunger of the flow tester has drop 6 mm) less than 135° C. is used for power conservation, and the fixing temperature of the toner image on the transfer member is reduced, this toner filming easily occurs. When this low melting point toner is used, toner filming occurs after several thousand image forming processes, and is believed to be caused by the softening of the low melting point toner which causes it to readily fuse to the photosensitive member.

When toner filming occurs, the charge flows horizontally on the surface of the photosensitive member when an electrostatic latent image is formed particularly under environmental conditions of high temperature and high humidity, thereby causing so-called image drift. For example, when image drift occurs in the case of reversal development wherein toner adheres to the exposure region, in the formation of the halftone dot image shown in FIG. 2, the location d1 at which the surface potential of the photosensitive member (e.g., −600 V) is reduced at a dot (e.g., to −50 V), as shown in FIG. 3A receives a charge flow as shown in FIG. 3B, such that the dot to be developed in a black color or the like is eliminated.

SUMMARY OF THE INVENTION

A main object of the present invention is to provide an image forming apparatus capable of adequately suppressing toner filming on the photosensitive member.

Another object of the invention is to provide an image forming apparatus capable of forming excellent images without image drift even when using low melting point toner.

These and other objects of the present invention are accomplished by an image forming apparatus comprising a photosensitive member, a developing device for developing a latent image formed on the photosensitive member and cleaning a residual toner remaining on the photosensitive member after transferring the developed image, the developing device adopting a toner satisfying the following conditions:

$$55° C. \leqq Tg$$

$$80° C. \leqq Ti \leqq 120° C.$$

$$100° C. \leqq Tm \leqq 135° C.,$$

wherein Tg is a glass transition temperature, Ti is a softening point at a moment a plunger of a flow tester starts to drop, and Tm is a softening point at a moment the plunger of the flow tester has dropped 6 mm, and a shaving means for shaving the surface of the photosensitive member within a range of about 2 μm or greater but less than 15 μm, within 7,000 rotations of the photosensitive member.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

FIG. 2 illustrates an example of a halftone dot image;

FIGS. 3A and 3(B) illustrate image drift.

DETAILED DESCRIPTION OF THE PREFERRED EMBODIMENTS

Figure 1:
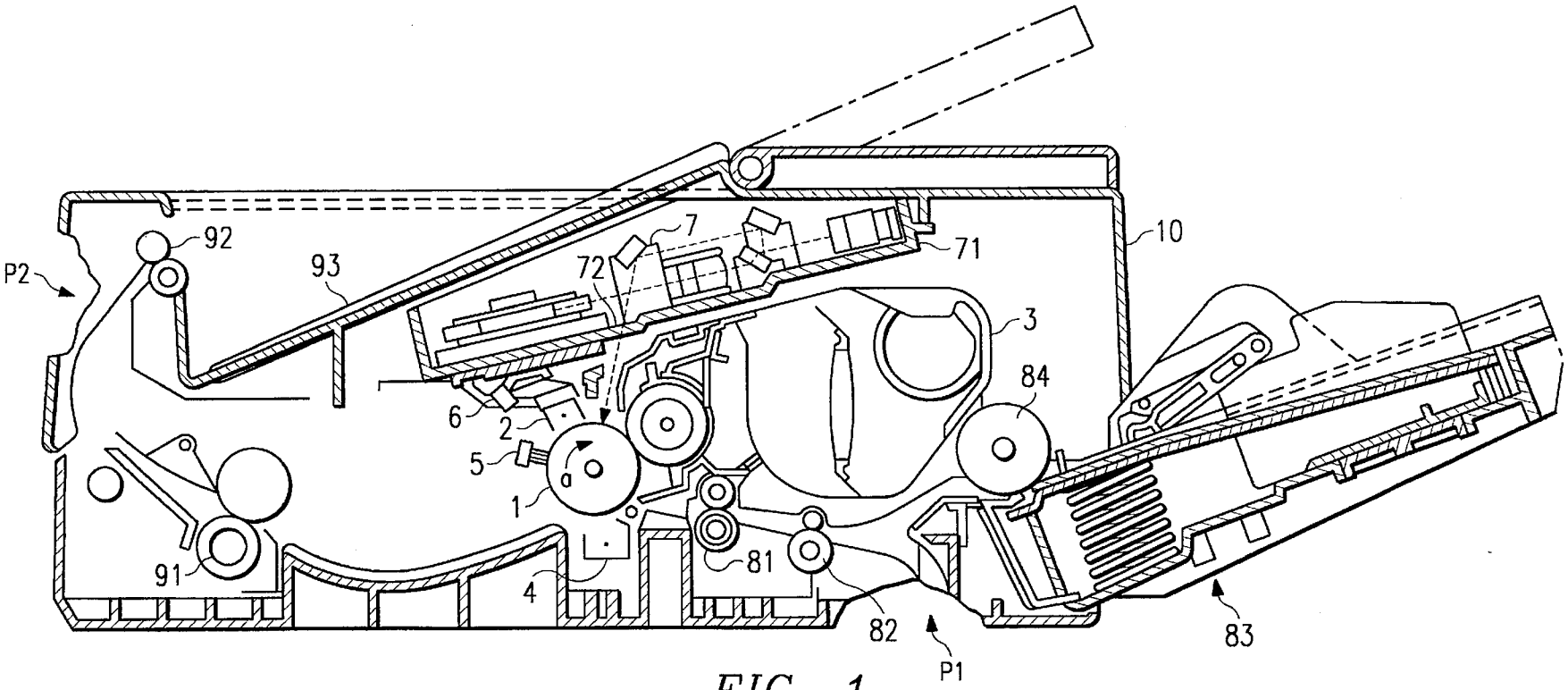
FIG. 1 briefly shows the construction of a printer of an embodiment of the present invention.

The inventor of the present invention considered to prevent the aforesaid image drift by shaving the surface of the photosensitive member a uniform amount.

The preferred embodiments of the present invention are described hereinafter with reference to the accompanying drawings.

The various components of the image forming apparatus of the present invention are discussed below.

(1) Photosensitive Member Shaving Means

The photosensitive member shaving means in the aforesaid image forming apparatus is not specifically limited insofar as said member is capable of uniformly shaving the photosensitive member. A stationary brush, rotating brush, blade, sheet-like film, flat panel, roller, mold-plane or like shaving member used normally in contact with a photosensitive member or in contact therewith as needed, or a shaving material mixed with a developer may be considered for use as the aforesaid shaving member. Furthermore, a shaving means may be combined with a contact charger, developing device, transfer charger or the like even without specifically providing a shaving member.

When shaving material mixed with a developer is used as a photosensitive member shaving means, inorganic particles which may be considered include glass beads, resin beads and the like, silica (silicon oxide), titanium oxide, alumina (aluminum oxide), barium titanate, strontium titanate and the like.

When the amount of shaving material used as the photosensitive member shaving means is less than 2 μm, toner filming is not adequately suppressed, whereas the service life of the photosensitive member is excessively shortened when the amount of said shaving material added to a developer is greater than 15 μm.

(2) Photosensitive Member Used in the Image Forming Apparatus of the Invention

Photosensitive member usable in the present invention are described in detail in the preferred embodiments which follow. Function-separated type organic photosensitive members having excellent photosensitivity with respect to long wavelength light such as semiconductor laser light (wavelength: 780 nm) and LED light (wavelength: 680 nm) may be used, although the present invention is not limited to use of a function-separated type organic photosensitive member.

Usable photosensitive members will have a photosensitivity with respect to long wavelength light as previously mentioned, in an image forming system using long wavelength light of an optical system such as a semiconductor laser (780 nm), LED array (680 nm) and the like. For example, a usable photosensitive member will have a photosensitivity in the visible range in image forming systems having a light source which emits visible light such as a liquid crystal array, PLZT shutter array and the like, image forming systems having a visible light laser as a light source, image forming systems having a fluorescent emitter array as a light source, or analog image forming systems having a visible light source and an optical system of lenses and mirrors such as that of typical copying machines.

The construction of the photosensitive member may be a function-separated organic photosensitive member provided with a separate charge-transporting layer superimposed over a charge-generating layer, or a so-called inverted-lamination type photosensitive member provided with a charge-generating layer superimposed over a charge-transporting layer, or a so-called single-layer type photosensitive member provided with a combined charge-generating function and charge-transporting function. Charge-generating materials, charge-transporting materials, bonding resins, additive agents and the like may be suitably selected from among commonly known materials in accordance with the purpose of use. Furthermore, the photosensitive materials are not limited to organic materials inasmuch as inorganic materials may be used, e.g., zinc oxide, cadmium sulfide, selenium alloy, amorphous silicon alloy, amorphous germanium alloy and the like.

Photosensitive members suitable for use in the present invention may be provided with an underlayer to improve charging characteristics, image quality, bonding to the substrate and the like. Examples of useful underlayer materials include ultraviolet curing resins, cold-setting resins, thermosetting resins and the like, mixed resins having resistance regulating materials dispersed n the aforesaid resins, vacuum deposition thin film materials formed by vapor deposition or ion plating of metal oxides or metal sulfides or the like in a vacuum, amorphous carbon film produced by plasma polymerization, amorphous silicon carbide film and the like.

The substrate of the photosensitive member suitable for use in the present invention is not specifically limited insofar as the surface of said photosensitive member substrate is electrically conductive, and its configuration may be cylindrical or belt-like as far as the photosensitive member is rotatable type. The surface of the substrate may be subjected to surface roughening process, oxidation process, coloring process and the like.

(3) Developing Device of the Image Forming Apparatus of the Present Invention

Developing devices usable in the present invention may be a monocomponent developing device using a monocomponent developer comprising a toner and employing a standard developing method or reversal developing method, or may be a two-component developing device using a two-component developer comprising a toner and a carrier.

Toners usable in the present invention are described hereinafter.

Developing toners usable in the present invention include positive charging toners, negative charging toners, optically transparent toners, magnetic toners, nonmagnetic toners and the like in accordance with the image forming process used and the polarity of the photosensitive member. With respect to color, not only black toner, but also yellow, magenta, cyan and like color toners may be suitably selected for use. The shape of the toner may be undefined, or a specific shape, e.g., spherical toner and the like. Colorants are described below.

Colorants

Examples of useful colorants include black pigments such as carbon black, copper oxide, manganese dioxide, aniline black, active carbine, ferrite, magnetite and the like.

Examples of useful yellow color pigments include chrome yellow, zinc yellow, cadmium yellow, yellow oxide, mineral fast yellow, nickel-titanium yellow, naples yellow, naphthol yellow S, Hanza yellow G, Hanza yellow 10G, benzidine yellow G, benzidine yellow GR, quinoline yellow lake, permanent yellow NCG, tartrazine lake and the like.

Examples of usable red pigments include chrome orange, molybdenum orange, permanent orange GTR, pyrazolone orange, vulcan orange, indathrene brilliant orange RK, benzidine orange G, indathrene brilliant orange GK, red oxide, cadmium red, red lead, permanent red 4R, lithol red, pyrazolone red, watchung red, lake red C, lake red D, brilliant carmine 6B, eosin lake, rhodamine lake B, alizarine lake, brilliant carmine 3B, vulcan fast orange GG, permanent red F4RH, permanent carmine FB and the like.

Examples of useful blue pigments include prussian blue, cobalt blue, alkali blue lake, victoria blue lake, phthalocyanine blue and the like. The amount of the aforesaid colorants is desirably 1~20 parts-by-weight, and preferably 3~15 parts-by-weight, with respect to 100 parts-by-weight of resin in the toner.

Magnetic Particles Used with Magnetic Toners

When magnetic fine particles are used, examples of usable magnetic particles include metals exhibiting strongly magnetic characteristics such as cobalt, iron, nickel and the like, as well as metal alloys such as aluminum, cobalt, iron, lead, magnesium, nickel, zinc, antimony, barium, bismuth, cadmium, calcium, manganese, selenium, titanium, tungsten, vanadium and the like, as well as mixtures, oxides and calcined materials (ferrite and the like) thereof.

The amount of added magnetic fine particles is desirably 1~80 parts-by-weight, and preferably 5~60 parts-by-weight, with respect to 100 parts-by-weight of resin in the toner.

Toner Binder Resins

Examples of useful binder resins include styrene resin, acrylic resin, methacrylic resin, styrene-acrylic copolymer resin, styrene-butadiene resin, olefin resin, polyester resin, epoxy resin, urethane resin, amide resin, phenol resin and like thermoplastic resins or thermosetting resins, as well as copolymers, block polymers, graft polymers, and polymer blends thereof.

The aforesaid polymers may be used individually or in combinations of two or more.

The aforesaid resins desirably will have a number-average molecular weight Mn such that $1{,}000 \leqq Mn \leqq 20{,}000$, and a weight-average molecular weight Mw such that $2 \leqq Mw \leqq 80$, and preferably said number-average molecular weight Mn will be such that $2{,}000 \leqq Mn \leqq 15{,}000$.

Anti-Offset Agents

When anti-offset agents are used, examples of usable agents include low-molecular weight polyethylene wax, low-molecular weight oxided polyethylene wax, low-molecular weight polypropylene wax, low-molecular weight oxided polypropylene wax, higher fatty acid wax, higher fatty acid ester wax, carnauba wax and the like used individually or in combinations of two or more.

The amount of anti-offset agent used is desirably 1~15 parts-by-weight, and preferably 2~8 parts-by-weight, relative to 100 parts-by-weight of resin in the toner.

Charge-Controlling Agent

When charge-controlling agents are used, examples of useful positive charge-controlling agents include nigrosine base EX, quaternary ammonium salts, polyamide compounds, imidazole compounds and the like.

Examples of useful negative charge-controlling agents include azo pigment chrome complex salt-azo dye, copper-phthalocyanine dye, chrome complex salt, zinc complex salt, aluminum complex salt and the like.

The amount of added charge-controlling agent is desirably 0.1~10 parts-by-weight, and preferably 0.5~5 parts-by-weight relative to 100 parts-by-weight of resin in the toner.

Post Processing Agents

When post processing agents are used, examples of useful post processing agents include fluidizing agents such as silica fine particles, titanium dioxide particles, alumina particles, magnesium fluoride particles, silicon carbide particles, boron carbide particles, titanium carbide particles, zirconium carbide particles, boron nitride particles, zirconium nitride particles, magnetite particles, molybdenum disulfide particles, aluminum stearate particles, magnesium stearate particles, zinc stearate particles and the like.

These fine particles may be used in hydrophobic processing with silane coupling agent, titanium coupling agent, higher fatty acid, silicon oil and the like.

Various types of organic fine particles such as styrene, acrylic, methacrylic, benzoguanamine, silicon, teflon, polyethylene, polypropylene and like produced by wet polymerization methods or vapor phase methods such as emulsion polymerization, soap-free emulsion polymerization, nonaqueous dispersion polymerization and the like may be used individually or in combination.

The amount of added fluidizing agent is desirably 0.05~5 parts-by-weight, and preferably 0.1~3 parts-by-weight, relative to 100 parts-by-weight of toner.

Specific embodiments of the apparatus of the present invention are described below.

FIG. 1 briefly shows the construction of the essential portion of a laser printer of a first embodiment of the present invention. This printer is an improvement of the laser printer model SP101 manufactured by Minolta Co., Ltd., and uses, together with a developing device, a stationary brush 5 to shave the photosensitive member in place of a cleaning device to remove the post-transfer residual toner remaining on the surface of photosensitive drum 1 so as to accomplish cleaning simultaneously with development.

The construction of this printer is briefly described hereafter. This printer is provided with a photosensitive drum 1, which is rotatably driven in the arrow a direction in the drawing by a drive means not shown in the drawing. Arranged sequentially around the periphery of photosensitive drum 1 are charger 2, developing device 3, transfer charger 4, stationary brush 5 for shaving the photosensitive member, and eraser 6. An image exposure unit 7 is disposed above photosensitive drum 1.

Provided in order on the right side of photosensitive drum 1 in the drawing are a pair of timing rollers 81, pair of intermediate rollers 82, and paper cassette 83, with a takeup roller 84 facing paper cassette 83. Provided in order on the left side of photosensitive drum 1 in the drawing are a pair of fixing rollers 91, and a pair of discharge rollers 92, with a discharge tray 93 facing said pair of discharge rollers 92.

Although not shown in the drawing, a cassette type paper supply unit may be provided in a bottom section so as to supply paper from section P1 in the drawing, and a so-called face-up tray may be connected to section P2 so as to discharge sheets from the section P2 in the drawing.

Photosensitive drum 1 is a negative-charging function-separated organic photosensitive member having excellent sensitivity for long wavelength light such as semiconductor laser light (wavelength: 780 nm) and LED light (wavelength: 680 nm), and is manufactured as described below.

One-part-by-weight τ-type nonmetallic phthalocyanine, 2 parts-by-weight polyvinyl butyral resin, and 100 parts-by-weight tetrahydrofuran were mixed for 24 hr using a ball mill to obtain a photosensitive fluid application. At this time, the viscosity of the photosensitive fluid application was 15 cp at 20°. The polyvinyl butyral resin comprised 3 molar % or less acetylation, 70 molar % butylation, and polymerization degree of 1,000.

This fluid application is applied by a dipping method on the surface of a cylindrical substrate measuring 240 mm long and 0.8 mm thick, so as to form, after drying, a charge-generating layer having a layer thickness of 0.4 μm. This cylindrical substrate was an aluminum alloy containing 0.7 percent-by-weight of magnesium and 0.4 percent-by-weight silicon, and the drying conditions were about 30 min in a recirculating air environment at 20° C.

Over the aforesaid charge-generating layer was applied a fluid application comprising 8 parts-by-weight hydrazone compound shown in the structural formula below, 0.1 parts-by-weight orange color (Sumiplast Orange 12; Sumitomo Chemicals, Ltd.) and 10 parts-by-weight polycarbonate resin (Panlite L-1250; Teijin Chemicals, Ltd.) dissolved in a solvent comprising 180 parts-by-weight tetrahydrofuran, said fluid application was dried to form a charge-transporting layer having a layer thickness of 28 μm.

The viscosity of the fluid application at this time was 240 cp at 20° C., and drying conditions were about 30 min in an environment of recirculating air at 100° C.

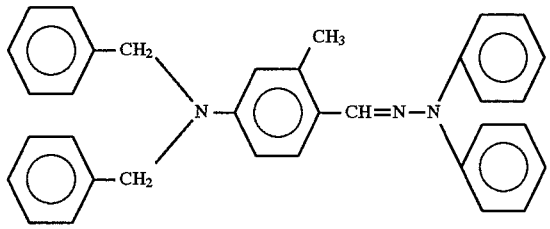

A function-separated type negative-charging organic photosensitive drum 1 having sequential laminations of a charge-generating layer and charge-transporting layer superimposed on a conductive substrate was thus prepared in the previously described manner.

The τ-type nonmetallic phthalocyanine used in the manufacture of the charge-generating layer has an X-ray diffraction pattern exhibiting strong peaks at Bragg angles (2θ±0.2 degrees) of 7.7, 9.2, 16.8, 17.4, 20.4, and 20.9 degrees when a Cu/Kα/Ni X-ray having a wavelength of 1.541 Å is used. In the infrared absorption spectrum, there are four absorption bands between 700~760 $cm^{-1}$ which are most intense at 751±2 $cm^{-1}$, and two absorption bands between 1320~1340 $cm^{-1}$ which have nearly equal intensity of 3288±3 $cm^{-1}$.

Stationary brush 5 used for shaving the photosensitive member is constructed so as to be capable of uniformly shaving the surface of photosensitive drum 1 within a range of about 2 μm or greater but less than 15 μm, within 7,000 rotations of the photosensitive drum 1.

The previously mentioned developing device 2 is supplied a charging voltage from a power source not shown in the drawings, so as to be capable of uniformly charging the surface of photosensitive drum 1 to −600 V.

Optical exposure device 7 is provided with a housing 71 within which are arranged a semiconductor laser generator, polygonal mirror, toroidal lens, half mirror, spherical surface mirror, folded mirror, reflecting mirror and the like. An exposure slit 72 is formed in the bottom of housing 71, such that an optical image may be exposed at the charged region on the surface of photosensitive drum 1 between charger 2 and developing device 3, thereby reducing the potential of the exposure region to about −50 V.

Developing device 3 is a so-called monocomponent developing device, used for reversal development. A negative-charging toner is used, which satisfies the following conditions:

55° C.≦Tg

80° C.≦Ti≦120° C.

100° C.≦Tm≦135° C.

In the aforesaid conditions, Tg is the glass transition temperature, Ti is the softening point at the moment the plunger of the flow tester starts to drop, and Tm is the softening point at the moment the plunger of the flow tester has dropped 6 mm.

Glass transition temperature Tg specifically is a shoulder value measured by a differential scanning calorimeter (DSC) under conditions of a temperature rise of 10° C./min. The softening point Ti specifically is the temperature at the moment the plunger of a flow tester starts to drop under conditions of a temperature rise of 6° C./min under 20 kg load using a 1 $mm^2$ nozzle. The softening point Tm specifically is the temperature measured at the moment the plunger of a flow tester drops 6 mm under conditions of a temperature rise of 6° C./min under 20 kg load using a 1 mm nozzle.

A developing bias voltage of −250 V is supplied to the aforesaid developing device from a power source not shown in the drawing.

In the case of the printer described above, the surface of photosensitive drum 1 is uniformly charged to −600 V by charger 2, and the charged region of said surface is subjected to optical image exposure from exposure device 7 so as to form an electrostatic latent image thereon. The formed latent image is developed as a toner image by developing device 3, which is then moved to a transfer region confronting transfer charger 4.

On the other hand, a transfer sheet is fed from paper cassette 83 by takeup roller 84, and delivered to a pair of timing rollers 81 via a pair of intermediate rollers 82, so as to transport said transfer sheet to the transfer region synchronously with the toner image formed on the surface of photosensitive drum 1. At the transfer region, the toner image on the transfer drum 1 is transferred onto the transfer sheet via the action of transfer charger 4, and said transfer sheet is transported to a pair of fixing rollers 91, whereupon the toner image is fused onto the transfer sheet which is subsequently ejected to discharge tray 93 via a pair of discharge rollers 92. After the toner image has been transferred onto the transfer sheet, the residual toner remaining on the surface of the photosensitive drum 1 is charged by charger 2 and subjected to optical exposure by exposure device 9 as necessary then again arrives at developing device 3, and the residual toner remaining on the nonimage region is collected by developing device 3 by means of the difference ΔV=350 V between the surface potential of the photosensitive drum and the developing bias potential. The residual charge is then eliminated by eraser 6. The surface of photosensitive drum 1 is slightly shaved by brush 5.

According to the aforesaid printer, since the developing toner has a low fusion point, power consumption can be conserved to only the power required by the pair of fixing rollers necessary to fix the toner image on the transfer sheet.

Since stationary brush 5 shaves the surface of photosensitive drum 1 within a range of 2 μm or greater but less than 15 μm during 7,000 revolutions of said photosensitive drum 1, toner filming of the surface of photosensitive drum 1 is prevented or adequately suppressed, such that excellent quality images without image drift can be formed over a long period thereby.

Experimental results determining the relationship between the amount of shaving of the photosensitive member by stationary brush 5 and toner conditions (e.g., Tg, Ti, Tm) are described hereinafter.

[Stationary Brush Used for Shaving the Photosensitive Member]

Rayon was used for the brush bristles to produce an insulated stationary brush having a bristle length of 5 mm. This brush was arranged under the five conditions described below relative to a photosensitive drum identical to the photosensitive drum 1 previously described, so as to have a nip width relative to said photosensitive drum, and an indentation overlap in contact with said photosensitive drum, and the amount of shaving of the surface layer was measured after 7,000 revolutions of said drum at a circumferential speed of 35 mm/sec. This measurement was accomplished by measuring the thickness of the photosensitive layer before and after 7,000 revolutions of the drum using a nondestructive type layer thickness measuring device (Electric Bench Drill No. 300; Aokiseiki, Ltd., and/or Permascope model EC8e2Tyl Helmut-Fischer, AEG.), and determining the difference in layer thickness. The nip width is the width at which the stationary brush contacts the surface of the photosensitive drum in the direction of movement of the drum surface. Measurement results are shown in the table below.

| Brush Conditions | No. 1 | No. 2 | No. 3 | No. 4 | No. 5 |
|---|---|---|---|---|---|
| Nip width (mm) | 2 | 2 | 5 | 10 | 10 |
| Indentation overlap (mm) | 0.5 | 1.0 | 1.5 | 1.5 | 2.0 |
| Amount shaved from drum (mm) | 1 | 2 | 10 | 15 | 20 |

[Toner]

Toner samples A~E were prepared in the manner described below.

Toner Sample B

First, a toner binder resin was prepared using the low-molecular weight polyester resin and high-molecular weight polyester resin described below.

(1) Low-Molecular Weight Polyester Resin

A reflux condenser, moisture separator, nitrogen gas ($N_2$) input tube, and mixing device were installed on a 4-hole flask of 5 liter capacity over a mantle heater, and 1,376 g of bisphenol propylene oxide compound and 433 g of isophthalic acid were loaded in the flask, and a dehydration polycondensation reaction was induced at 220°~270° C. while $N_2$ gas was introduced to the flask, to obtain a low-molecular weight polyester resin having an Mw of 4,000, and Tg of 58° C.

(2) High-Molecular Weight Polyester Resin

A reflux condenser, moisture separator, nitrogen gas ($N_2$) input tube, and mixing device were installed on a 4-hole flask of 5 liter capacity over a mantle heater, and 1,720 g of bisphenol propylene oxide compound, 1,028 g of isophthalic acid, 328 g of 1,6-dipropyl-1,6-hexan diol, and 74.6 g of glycerine were loaded in the flask, and a dehydration polycondensation reaction was induced at 240° C. while $N_2$ gas was introduced to the flask, to obtain a high-molecular weight polyester resin having an Mw of 6,800, and Tg of 38° C.

A Henschel mixer was used to dry blend 85 parts-by-weight of the aforesaid low-molecular weight polyester resin and 15 parts-by-weight of the aforesaid high-molecular weight polyester resin to suitable uniformity, then 40 parts-by-weight diphenyl methane-4,4-diisocyanate were prepared by a heating kneader and reacted for 1 hr. at a temperature of 120° C., to obtain a urethane-transformed polyester resin used as a toner binder resin.

Then, the toner was produced using the aforesaid binder resin. Details of toner preparation are described below.

| | |
|---|---|
| Urethane-transformed polyester resin | 100 pbw |
| Carbon black (Mogal L; Cabot, Inc.) | 5 pbw |
| Charge-controlling agent (S-34; Oriental Chemicals, Ltd.) | 2 pbw |
| Anti-offset agent (TS-200; Sanyo Chemicals, Ltd.) | 3 pbw |

(pbw = parts-by-weight)

After the aforesaid materials were mixed using a Henschel mixer, it was kneaded using a dual-shaft extruder. Thereafter, the mixture was cooled and coarsely pulverized, then finely pulverized using a jet mill pulverizer. The material was then classified using a forced-air classifier to obtain fine particles having a mean particle size of 8.6 μm (3.8% less than 5 μm, 20%).

To the aforesaid particles was added 0.5% hydrophobic silica (H-2000; Hechist, Inc.), and the mixture was processed in a Henschel mixer for 60 sec at 2,500 rpm to obtain toner particles (Toner sample B).

Toner Sample A

Toner sample A was produced under the same conditions as toner sample B with the exception the mixing proportions of polyester resins were changed as described below.

Toner sample A was produced using 90 pbw low-molecular weight polyester resin and 10 pbw high-molecular weight polyester resin.

Toner Sample C

Toner sample C was produced under the same conditions as toner sample B with the exception the mixing proportions of polyester resins were changed as described below.

Toner sample C was produced using 80 pbw low-molecular weight polyester resin and 20 pbw high-molecular weight polyester resin.

Toner Sample D

Toner sample D was produced under the same conditions as toner sample B with the exception the mixing proportions of polyester resins were changed as described below.

Toner sample D was produced using 70 pbw low-molecular weight polyester resin and 30 pbw high-molecular weight polyester resin.

Toner Sample E

Toner sample E was produced under the same conditions as toner sample B with the exception the mixing proportions of polyester resins were changed as described below.

Toner sample E was produced using 50 pbw low-molecular weight polyester resin and 50 pbw high-molecular weight polyester resin.

Toner sample E was not what is typically referred to as a low fusion point toner, and was a normal range toner used as a reference example.

Each of the aforesaid samples had the Tg, Ti, and Tm values listed below as measured in the previously described manner.

| Sample No. | A | B | C | D | E |
|---|---|---|---|---|---|
| Tg(°C.) | 53 | 57 | 60 | 63 | 70 |
| Ti(°C.) | 78 | 85 | 93 | 105 | 120 |
| Tm(°C.) | 95 | 105 | 108 | 125 | 135 |

Tg: Measured by differential scanning calorimeter (DSC), model SSC-570 (Mfr: Seiko Electronics, Ltd.) under conditions of temperature rise of 10° C./min; shoulder value measured.

Ti,Tm: Measured by flow tester model CFT-500 (Shimazu Seisakusho, Ltd.) using a 1 mm×10 mm nozzle; 20 kg load; temperature rise of 6° C./min Ti: Temperature when the plunger starts to move Tm: Temperature when the plunger drops 6 mm The aforesaid stationary brush conditions (Nos. 1~5) and toner samples (A~E) were combined as shown in the table below, and respectively used in the printer of the embodiment shown in FIG. 1. The apparatus was used to print images which were evaluated for image drift. The evaluation results are shown in a later table.

The toner samples A~E were placed in the polyester flasks and preserved for 5 hr at high room temperature of 50° C., then filtered through a 105 μmm sieve and ranked by the percentage of residue relative to the total amount to investigate the toner flocculation rate.

| Flocculation Rank | Amount of Residue |
|---|---|
| 4 | 0~5% |
| 3 | 6~15% |
| 2 | 16~25% |
| 1 | 26% and more |

In the present monocomponent developing method, toner ranked 2 or lower were deemed unsuitable for practical use due to toner flocculation in the vicinity of the regulating blade. Sample A was not tested in the printer experiment.

Image evaluation was performed for the aforesaid combinations by printing a 5% B/W character chart 5,000 times without a cleaning device, maintaining the printer overnight under environmental conditions of 30° C. and 85% relative humidity, and outputting a halftone dot image early the next morning to observe any image drift. Image evaluation was divided into the five ranks shown below.

(1) Broad areas of non-printing dots clearly visible; not usable (2) Local areas of non-printing dots clearly visible; not usable (3) Faint image drift visible, but usable (4) No visible image drift, but partial reduction of black dots in 10× magnified photographs (5) No visible image drift, and complete absence in 10× magnification photographs Image evaluations for image drift for combinations of stationary brush conditions (Nos. 1~5) and toner samples (B~E) are shown below.

| Brush | Amt. shaved | Toner sample | | | |
|---|---|---|---|---|---|
| Conditions | from drum | B | C | D | E |
| no brush | (0 μm) | (1) | (2) | (2) | (3) |
| No. 1 | (1 μm) | (2) | (2) | (2) | (3) |
| No. 2 | (2 μm) | (3) | (3) | (4) | (4) |
| No. 3 | (10 μm) | (4) | (5) | (5) | (5) |
| No. 4 | (15 μm) | (5) | (5) | (5) | (5) |
| No. 5 | (20 μm) | (5) | (5) | (5) | (5) |

(1)~(5) are image evaluation ranks.

(1)~(5) are image evaluation ranks.

The above experimental results indicate that toner which satisfy the conditions of 55° C.≦Tg, 0° C.≦Ti≦120° C., and 100° C.≦Tm≦135° C. require brushes Nos. 2~5 (shaving less than 2 μm from the photosensitive drum after 7,000 revolutions. In the previously mentioned experiments, however, brush conditions which remove 20 μm from the drum shave excessive amounts from the photosensitive drum, causing numerous pinholes resulting in local black dots in an image, such that brush conditions which remove 20 μm from the drum reduce the service life of the photosensitive member and are therefore deemed unsuitable for use.

Thus, a means which reduces a photosensitive member 2 μm or more but less than 15 μm in 7,000 revolutions is deemed suitable for use as a shaving means for the photosensitive member in the present invention.

The present invention is an image forming apparatus which forms an electrostatic latent image on the surface of a photosensitive member, said latent image is developed as a visible toner image by a developing device, said toner image is transferred onto a transfer member, and after said transfer the residual toner remaining on the surface of the photosensitive member is removed by said developing device, and uses a low melting point toner as the developing toner to conserve power consumption, so as to prevent or adequately suppress toner filming of the photosensitive member, and thereby produce excellent images without image drift.

Although the present invention has been fully described by way of examples with reference to the accompanying drawings, it is to be understood that various changes and modifications will be apparent to those skilled in the art. Therefore, unless otherwise such changes and modifications depart from the scope of the present invention, they should be construed as being included therein.

What is claimed:

1. An image forming apparatus comprising:

a photosensitive member;

a developing device for developing a latent image formed on the photosensitive member, and cleaning a residual toner remaining on the photosensitive member after transferring the developed image, the developing device including a toner satisfying the following conditions:

55° C.≦Tg

80° C.≦Ti≦120° C.

100° C.≦Tm≦135° C., wherein Tg is a glass transition temperature, Ti is a softening point at a moment a plunger of a flow tester starts to drop, and Tm is a softening point at a moment the plunger of the flow tester has dropped 6 mm; and a shaving means for shaving a surface of the photosensitive member within a range of about 2 μm or greater but less than 15 μm, within 7,000 rotations of the photosensitive member.

2. The image forming apparatus as claimed in claim 1, wherein said shaving means is an insulated brush.

3. The image forming apparatus as claimed in claim 1, wherein said developing device develops the latent image with a mono-component developer.

4. The image forming apparatus as claimed in claim 3, wherein said developing device develops the latent image by reversal development.

* * * * *